US007059886B2

(12) United States Patent
Ju

(10) Patent No.: US 7,059,886 B2
(45) Date of Patent: Jun. 13, 2006

(54) MULTISTAGE MOVABLE HINGE

(75) Inventor: Ted Ju, Keelung (TW)

(73) Assignee: Lotes Co., Ltd, Keelung (TW)

( * ) Notice: Subject to any disclaimer, the term of this patent is extended or adjusted under 35 U.S.C. 154(b) by 0 days.

(21) Appl. No.: 11/235,187

(22) Filed: Sep. 27, 2005

(65) Prior Publication Data

US 2006/0068651 A1 Mar. 30, 2006

(30) Foreign Application Priority Data

Sep. 28, 2004 (CH) ..... 2004 2 0088699

(51) Int. Cl.
*H01R 4/50* (2006.01)

(52) U.S. Cl. ..... 439/342; 439/857
(58) Field of Classification Search ..... 439/342, 439/857

See application file for complete search history.

(56) References Cited

U.S. PATENT DOCUMENTS

| | | | | |
|---|---|---|---|---|
| 6,461,182 | B1 * | 10/2002 | Hsu | 439/342 |
| 6,478,599 | B1 * | 11/2002 | McHugh et al. | 439/342 |
| 6,537,095 | B1 * | 3/2003 | Azuma | 439/342 |
| 2003/0096525 | A1 * | 5/2003 | Hsu | 439/342 |

* cited by examiner

*Primary Examiner*—Tho D. Ta
(74) *Attorney, Agent, or Firm*—Troxell Law Office, PLLC

(57) ABSTRACT

An electric connector terminal has an approximate U shape. The electric connector terminal has two arms and a connecting portion connected the two arms. The two lateral surfaces of the arms are formed with a slot therebetween. The slot has reduced widths. An narrower side of the slot is slightly smaller than a width on a pin of a chipset. A pin of a chipset can be inserted into a wider part of the slot and then transversally move to the narrow portion of the slot to be in contact with the electric connector terminal and be clamped in the clamping trench. Each arm is inclined to be closer to one another so that the two arms are formed with inclined lateral surfaces, respectively.

5 Claims, 3 Drawing Sheets

MULTISTAGE MOVABLE HINGE

BACKGROUND OF THE INVENTION (a) Field of the Invention

The present invention relates to connectors, and particularly to an electric connector terminal, wherein a pin of a chipset can be assembled to the electric connector terminal easily and the density of the pin can be increased.

(b) Description of the Prior Art

U.S. Pat. No. 5,797,774 discloses an electric connector terminal for assembling a pin of a chipset. The electric connector terminal has two arms for receiving a pin of a chipset. The two arms extends upwards and inclines inwards. Thereby the pins of the chipset are slidably assembled into the interior of a space enclosed by the two arms and are fixed therein. The pin is installed into the space from external to the interior.

Although above assembly of the electric connector terminal has zero insertion force, in assembly, the pin is moved from exterior to interior, a greater space is needed. It is not beneficial for the trends of compact sizes and high densities.

In an improvement design, as shown in FIG. 1, the electric connector terminal has mirror-symmetrical to a center plane thereof. The electric connector terminal has a base in the body of an electric connector, distal end extended from the base and two arms extended to a position far away from the distal end. A distal end of each arm is formed with an elastic arm. A space for receiving a pin of a chipset is formed between the two elastic arms. A distal end of each arm is formed with a second lateral surface. The two lateral surfaces of the two arms are parallel to one another. A second lateral surface is inclined to a central plane. A width of the second lateral surface is smaller than that of the pin of a chipset. Thereby the pin can be inserted therein.

Referring to FIG. 1, the two second lateral surfaces extended form the arms of the prior art electric connector terminal are formed as inclined surfaces. When the chipset is moved to make the pin thereof being inserted into the electric connector terminal, a force is applied to the inclined surface. Similarly, the inclined surface applies a reactive force to the pin. Since the arm is too short, the pin will suffer from a greater force and thus the pushing force of the pin of the chipset is too greater. It is difficult to push the pin forwards. Even the length of the inclined surface is prolonged, since the second lateral surface extends from a position vertical to the base, as a result, the terminal will occupy a larger space. Thereby the terminal cannot be arranged with higher density. Thereby it is not beneficial to the compact and high density design.

SUMMARY OF THE INVENTION

Accordingly, the primary object of the present invention is to provide an electric connector terminal, wherein a pin of a chipset can be assembled to the electric connector terminal easily and the density of the pin can be increased.

To achieve above objects, the present invention provides an electric connector terminal which has an approximate U shape. The electric connector terminal has two arms and a connecting portion connected the two arms. The two lateral surfaces of the arms are formed with a slot therebetween. The slot has reduced widths. An narrower side of the slot is slightly smaller than a width on a pin of a chipset. A pin of a chipset can be inserted into a wider part of the slot and then transversally move to the narrow portion of the slot to be in contact with the electric connector terminal and be clamped in the clamping trench. Each arm is inclined to be closer to one another so that the two arms are formed with inclined lateral surfaces, respectively.

The various objects and advantages of the present invention will be more readily understood from the following detailed description when read in conjunction with the appended drawing.

DETAILED DESCRIPTION OF THE PREFERRED EMBODIMENTS

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
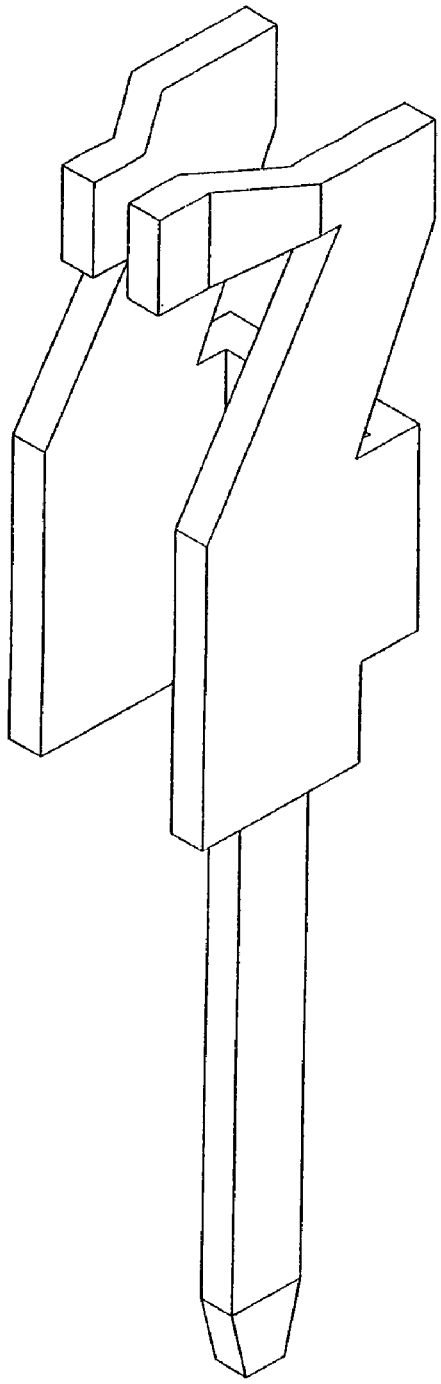
FIG. 1 PRIOR ART
FIG. 1 is a perspective view of the prior art electric connector terminal.
Figure 2:
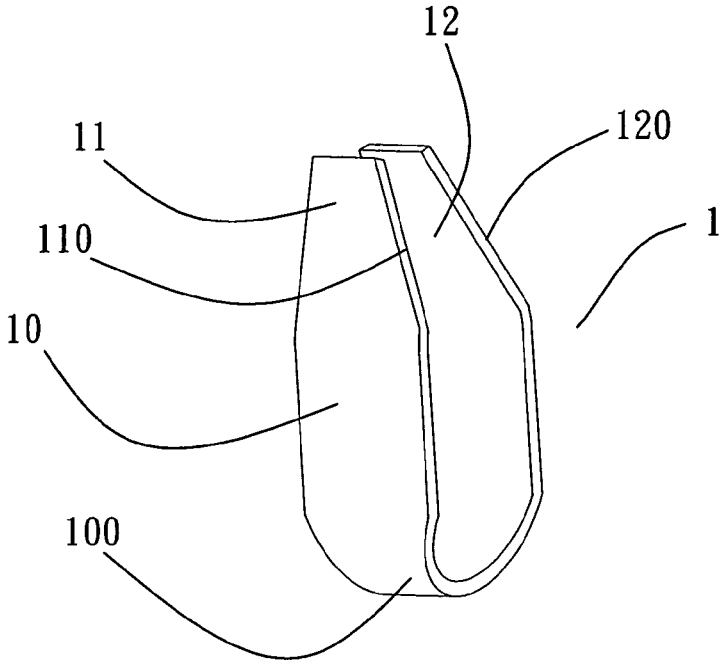
FIG. 2 is a perspective view of the electric connector terminal of the present invention.
Figure 3:
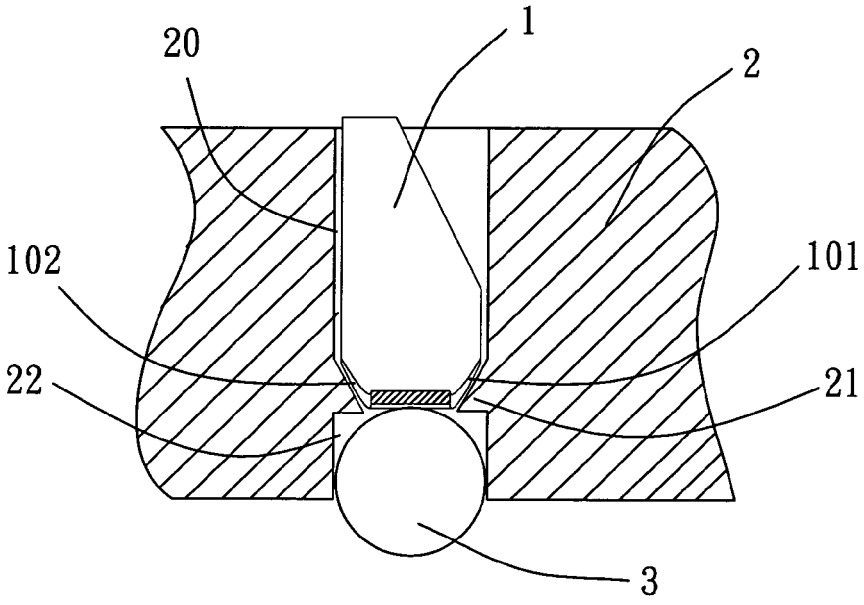
FIG. 3 is a schematic view showing the aseembly of the electric connector terminal, insulating body and the tin ball according to the present invention.
Figure 4:
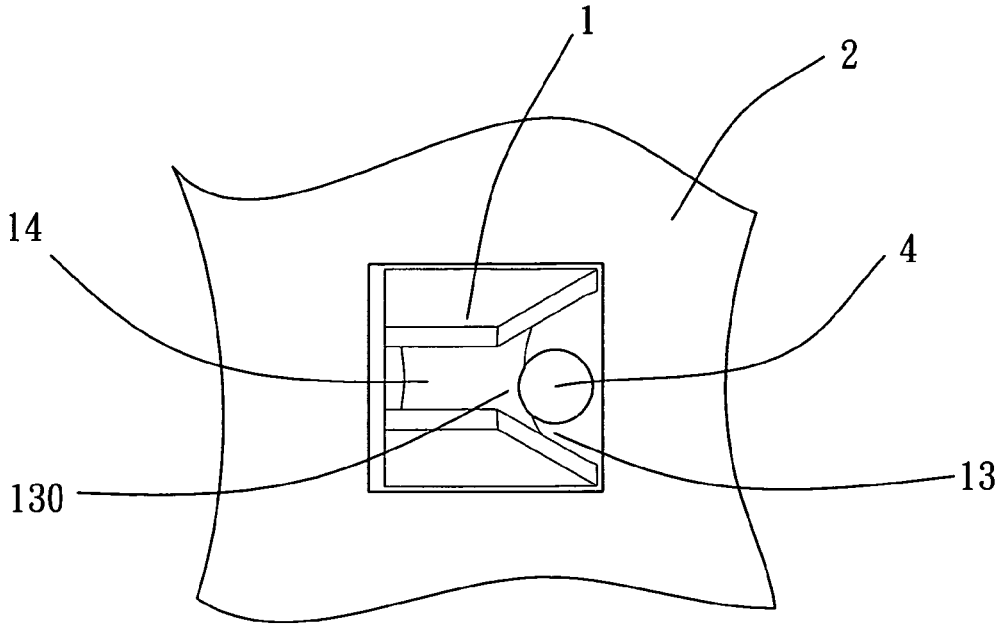
FIG. 4 is an elevation view showing that the electric connector terminal of the present invention is inserted by a pin of a chipset.

Referring to FIGS. 2, 3 and 4, the electric connector terminal 1 of the present invention has an approximate U shape. The electric connector terminal 1 has two arms 11, 12 and a connecting portion 10 connected the two arms 11, 12. Each arm is inclined to be closer to one another so that the two arms 11, 12 are formed with inclined lateral surfaces 110, 120, respectively. The two lateral surfaces 110, 120 are formed with a slot 13 therebetween. The slot 13 has reduced widths. A narrower side 130 of the slot 13 is slightly smaller than a width on a pin 4. The top ends of the arms 11, 12 are formed with a clamping trench 14. A pin 4 of a chipset can be inserted into a wider part of the slot 13 and then transversally move to the narrow portion 130 of the slot 13 to be in contact with the electric connector terminal 1 and be clamped in the clamping trench 14.

Two sides 101, 102 of a bottom of the connecting portion 10 are reduced inwards so that that it can be assembled to an insulating body 2. The insulating body 2 is formed with a receiving groove 20. Two protrusions 21 are extended from a wall of the receiving groove 20 and are extended toward a middle section of the receiving groove 20 so as to be corresponding to the bottom of the electric connector terminal 1. Thereby the electric connector terminal 1 can be matched to the insulating body 2. A receiving chamber 22 is formed between the bottom 100 of the electric connector terminal 1 and the wall of the receiving groove 20 for receiving a tin ball 3. The tin ball 3 is connected to the bottom 100 of the electric connector terminal 1.

Figure 5:
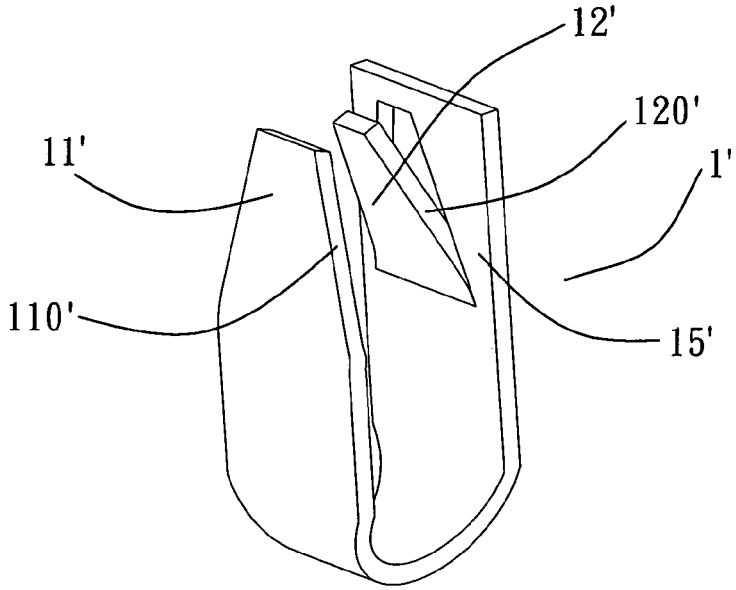
FIG. 5 is a perspective view of another embodiment of the electric connector terminal of the present invention.

Referring to FIG. 5, another embodiment of the present invention is illustrated. In this embodiment, only arm 11' is inclined inwards, but another arm 15' is not inclined inwards. A protrusion 12' is punched from the arm 15' to be inclined inwards. One side 120 of the protrusion 12' has an inclined edge.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An electric connector terminal having an approximate U shape; the electric connector terminal having two arms and a connecting portion connected the two arms; the two lateral surfaces of the arms being formed with a slot therebetween; the slot having reduced widths; a narrower side of the slot being slightly smaller than a width on a pin of a chipset; a pin of a chipset can be inserted into a wider part of the slot and then transversally moving to the narrower side of the slot to be in contact with the electric connector terminal and be clamped in the clamping trench, wherein only one arm is inclined inwards, but another arm is not inclined inwards; a protrusion is punched from the arm not included inwards; and the protrusion is inclined inwards; and one side of the protrusion has an inclined edge.

2. The electric connector terminal as claimed in claim 1, wherein the top ends of the arms are formed with a clamping trench for clamping a pin of a chipset.

3. The electric connector terminal as claimed in claim 1, wherein the top ends of the arms are formed with a clamping trench for clamping a pin of a chipset.

4. The electric connector terminal as claimed in claim 1, wherein each arm is inclined to be closer to one another so that the two arms are formed with inclined lateral surfaces, respectively; the two lateral surfaces are formed with a slot therebetween; and the slot has reduced widths then other portions of the two arms.

5. The electric connector terminal as claimed in claim 4, wherein the top ends of the arms are formed with a clamping trench for clamping a pin of a chipset.

* * * * *